US005364052A

United States Patent [19]

De Gruttis

[11] Patent Number: 5,364,052

[45] Date of Patent: Nov. 15, 1994

[54] SHELF SUPPORT SYSTEM

[76] Inventor: Costanzo De Gruttis, 7 Sheen Park, Richmond SY TW91UN, England

[21] Appl. No.: 64,132

[22] PCT Filed: Nov. 26, 1991

[86] PCT No.: PCT/GB91/02090

§ 371 Date: May 26, 1993

§ 102(e) Date: May 26, 1993

[87] PCT Pub. No.: WO92/09222

PCT Pub. Date: Jun. 11, 1992

[30] Foreign Application Priority Data

Nov. 26, 1990 [GB] United Kingdom ..... 9025641
Jul. 24, 1991 [GB] United Kingdom ..... 9115939

[51] Int. Cl.[5] ..... E04G 3/08

[52] U.S. Cl. ..... 248/245; 108/108

[58] Field of Search ..... 248/243, 244, 245, 246, 248/242, 235; 108/108, 110

[56] References Cited

U.S. PATENT DOCUMENTS 3,136,520 6/1964 Reiss ..... 248/243
4,313,587 2/1982 Loeschen ..... 248/235 X
4,895,331 1/1990 Nehls ..... 108/108 X
4,901,965 2/1990 Bowman ..... 108/108 X

FOREIGN PATENT DOCUMENTS 2319282 3/1976 France .
280021 7/1913 Germany .
450657 4/1968 Switzerland .
943214 12/1963 United Kingdom .

*Primary Examiner*—Ramon O. Ramirez
*Attorney, Agent, or Firm*—Richard C. Litman

[57] ABSTRACT

The system comprises a shelf support arm (2) adapted to be mounted horizontally and a support bar (1) adapted to be disposed vertically and means for mounting the bar (1) to a vertical wall or other support surface, sliding means enabling the arm (2) to slide up and down the bar (1) and retaining means to secure the arm (2) to the bar (1) at any desired position. The arm (2) is a two sided member (9,9) with an external flange (3) at the end of each side (9) and the bar (1) has a profiled section that provides spaced apart and opposed recesses (8,8) to accommodate the flanges (3,3). The retaining means includes expandable means (4,5,6,7 and 10) held by the arm (2) and operable by actuating means (4,6,10) to urge the flanges (3,3) apart laterally and to engage the bar recesses (8,8) sufficiently to secure the arm (2) in a desired position.

8 Claims, 2 Drawing Sheets

SHELF SUPPORT SYSTEM

The present invention relates to a shelf support system which is suitable for assembly by amateurs or professionals in order to support a shelf on a wall or similar vertical support surface by means of a horizontal shelf support arm which extends from the wall or similar vertical support surface at right angles and engages with a vertically extending support bar fixable to the wall or similar vertical support surface. In the system of this invention the shelf support arm can be moved into an infinitely variable number of positions up and down the vertically extending support bar.

The invention is an improvement over various systems on the market, which consist of two or more vertically disposed wall bars which are perforated along their length with one or more lines of slits. Two or more shelf support arms are used for supporting the shelf. Each shelf support arm has hook-shaped extensions which engage in the parallel slits in one wall bar so that the shelf support arm is held horizontal and at right angles to the wall. This known type of shelf support system is difficult to align, since each of the wall bars must be affixed to the wall so that the supporting slits are in precise horizontal alignment, an adjustment not easy for the average D.I.Y. practitioner. Such perforated bars have the further disadvantage that the support arms can only be adjusted from slit to slit in steps. The shelf cannot easily be adjusted by less than the interval between successive slits. The slit bar is not elegant in appearance, and the slits tend to gather dust, which is a disadvantage in the home or office.

According to the present invention there is provided a shelf support system comprising a shelf support arm adapted to be mounted horizontally and a support bar adapted to be disposed vertically and means for mounting the support bar to a vertical wall or other support surface, sliding means enabling the arm to slide up and down the support bar and retaining means to secure the-support arm to the support bar at any desired position, wherein the support arm is a two sided member with an external flange at the end of each side and the support bar has a profiled section that provides spaced apart and opposed recesses to accommodate the said external flanges of the support arm, the retaining means including expandable means held by the support arm and operable by actuating means to urge the said flanges of the support arm apart laterally and to engage the said support bar recesses sufficiently to secure the support arm in a desired position.

The expandable means may take the form of a bolt which passes upwardly through a hole in a bottom portion of the arm adjacent to the flanges and a nut spanning the gap between the sides of the arm engageable with the bolt, the flanges being caused to separate laterally from one another by tightening the bolt to cause the nut to ride over opposed protrusions provided on the inner surfaces of the arms and thereby increasing the gap between the said flanges. At least a portion of the outer edges of the said flanges may be provided with teeth to engage more positively the said recesses in the support arm; the teeth nearer the protrusions may be made shorter than those more remote from the protrusions. The bolt may extend substantially along the whole length of the said flanges.

The support bar may be provided with holes therein to enable it to be screwed or bolted to a vertical support wall as disclosed in the specification of the prior application GB 90 25 641.3 (De Gruttis) and in the specification of co-pending application which claims priority from GB 90 25 641.3 (De Gruttis).

By way of example a preferred embodiment of the invention will now be described with reference to the accompanying diagrammatic drawings, wherein.

Figure 1:
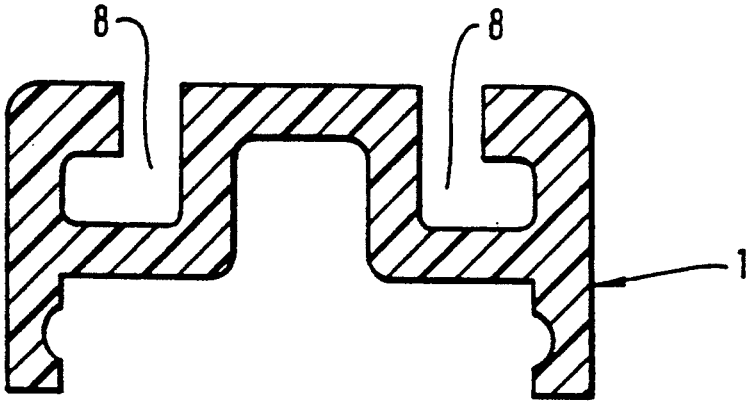
FIG. 1 is a cross-section of a profiled shelf support bar.

FIG. 1 shows a profiled shelf support bar 1 which may be produced by extrusion. The profiled section shows recesses 8 to accommodate outwardly facing flanges 3 of a shelf support arm 2. The flanges 3 may have chamfered corners to assist insertion. The shelf support bar I is intended to be fixed to a vertical support wall and may be provided with holes therein (not shown) to enable it to be screwed or bolted to a vertical support wall, as shown in the specification of the prior application GB 90 25 641.3 (De Gruttis) and in the specification of the co-pending application which claims priority from GB 90 25 641.3 (De Gruttis).

Figure 2:
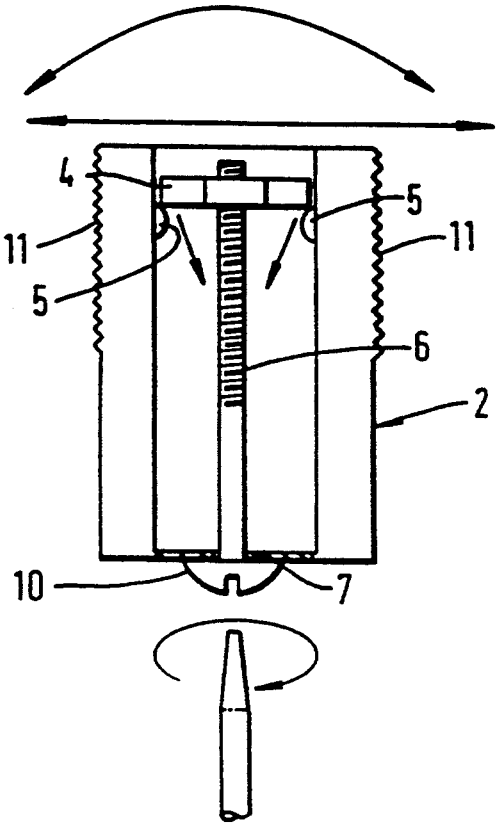
FIG. 2 is a section through a shelf support arm fitted with an expandable means.
Figure 3:
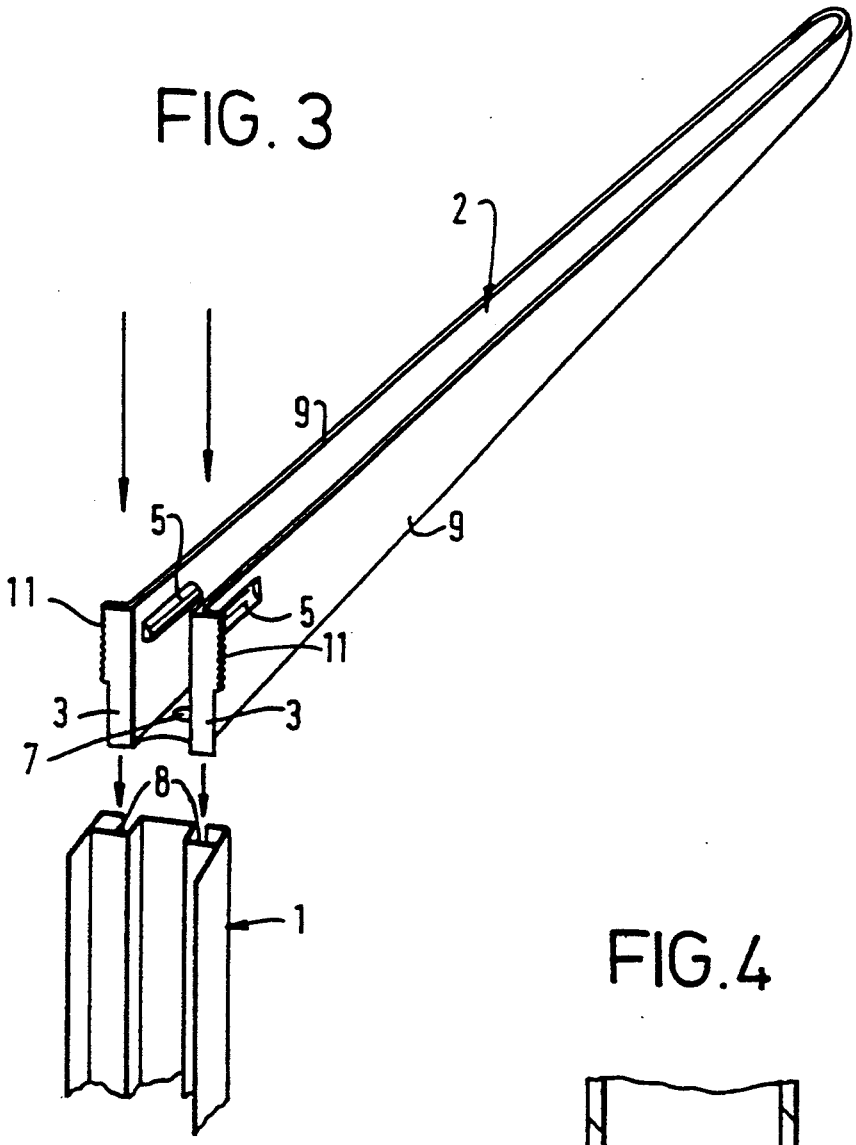
FIG. 3 is a perspective view of the shelf support arm of FIG. 2 ready to be fitted into the support bar of FIG. 1.
Figure 4:
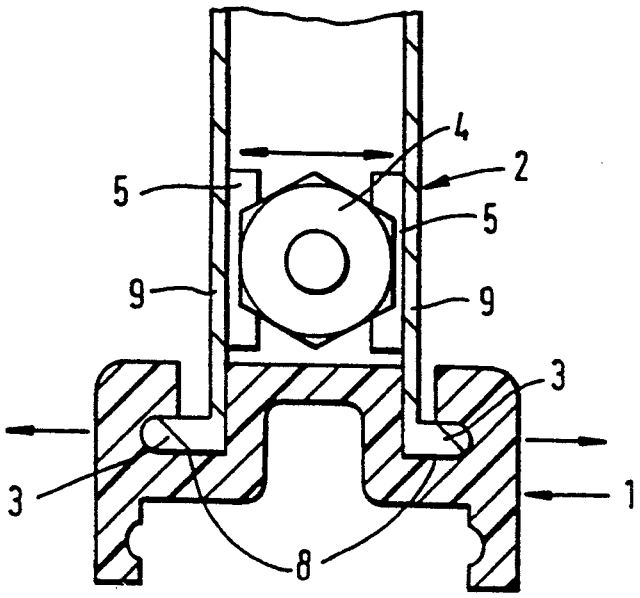
FIG. 4 is a section of the support arm of FIGS. 2 and 3 coupled with the support bar of FIG. 1 and including the expandable means shown in FIG. 2.

The rear part of the support arm 2 has its two outwardly facing flanges 3 to engage the recesses 8 of the support bar 1 as clearly shown in FIG. 1. The sides 9 of the rear part of the support arm 2 are expandable and as shown in FIGS. 2 to 4, a nut 4 rests on top of two protrusions 5 inside the support arm 2. The top surface of each protrusion 5 slopes at an angle towards the centre of the support arm 2. A bolt 6 passes through a hole 7 in the support arm 2 and has a head 10 which is wider than the hole 7.

The nut 4 may be chamfered on the side contacting protrusions 5 or may be a threaded rod or block. The nut 4 may have a conical profile. The protrusions 5 may be conical and may be located centrally on the sides 9 of the arm 2. The number and distribution and shapes of the protrusions 5 inside the support arm may vary as desired.

A user will tighten the bolt 6 by screwing it into the nut 4 and so draw the nut downwards onto the inclined protrusions 5 forcing the flanges 3,3 apart. This causes outwardly facing toothed portions 11 of the flanges 3 to engage with the recesses 8 of the support bar 1, so holding firmly the support arm 2 fixed with respect to the support bar 1. The support arm 2 may be made of mild steel and the support bar I may consist of an aluminium or plastics material extrusion. Preferably the teeth 11 will be made of harder material than that of the support bar 1 so as to provide a positive location. Since the flanges 3,3 open by expansion to form a tapered opening wider at the top than the bottom it may well be advantageous to make the lower teeth 11 longer than the upper teeth 11 for an even better gripping effect.

The shelf support system specifically described and illustrated offers a positive location of the support arm 2 on the support bar 1 where such a positive location is necessary or desirable as compared with the frictional versions disclosed in the specifications of the aforementioned prior application and co-pending application. By way of testing, the present embodiment has been loaded to a vertical force of over 100 kilograms on a single support arm 2, with no movement of the shelf support system; also the support arm position can be adjusted below with the shelf in situ which is not always possible with previously proposed shelf support systems.

I claim:

1. A shelf support system comprising a shelf support arm adapted to be mounted horizontally and a support bar adapted to be disposed vertically and means for mounting the support bar to a vertical wall or other support surface, sliding means enabling the arm to slide up and down the support bar and retaining means to secure the support arm to the support bar at any desired position, wherein the support arm is a two sided member with an external flange at the end of each side and the support bar has a profiled section that provides spaced apart and opposed recesses to accommodate the said external flanges of the support arm, the retaining means including expandable means held by the support arm and located within and between the two sides of the support arm and operable by actuating means to urge the said flanges of the support arms apart laterally and to engage the said support bar recesses sufficiently to secure the support arm in a desired position, said expandable means including a bolt passing upwardly through a hole in a bottom portion of said arm adjacent to said flanges, a nut spanning the gap between the sides of said arm engageable with said bolt, said flanges being caused to separate laterally from one another by tightening of said bolt to cause said nut to ride over opposed protrusions provided on the inner surfaces of the arms and thereby increasing the gap between said flanges.

2. A shelf support system according to claim 1, wherein the bolt extends substantially along the whole length of the said flanges.

3. A shelf support system according to claim 1, wherein the nut is chamfered on the side intended to contact the protrusions or has a conical profile.

4. A shelf support system according to claim 1, wherein the nut takes the form of a threaded rod or block.

5. A shelf support system according to claim 1, wherein the protrusions are conical.

6. A shelf support system according to claim 1, wherein the protrusions are located centrally on the sides of the support arm.

7. A shelf support system according to claim 1, wherein the said flanges include outer edges and at least a portion of the outer edges is provided with teeth to engage more positively the said recesses in the support arm.

8. A shelf support system according to claim 7, wherein the teeth nearer the protrusions are made shorter than those more remote from the protrusions.

* * * * *